US010362852B2

(12) United States Patent
Halloway

(10) Patent No.: US 10,362,852 B2
(45) Date of Patent: Jul. 30, 2019

(54) ERGONOMIC MANICURING SUPPORT

(71) Applicant: Lori Ellen Halloway, Saline, MI (US)

(72) Inventor: Lori Ellen Halloway, Saline, MI (US)

(73) Assignee: Lori Ellen Halloway, Saline, MI (US)

( * ) Notice: Subject to any disclaimer, the term of this patent is extended or adjusted under 35 U.S.C. 154(b) by 0 days.

(21) Appl. No.: 15/701,676

(22) Filed: Sep. 12, 2017

(65) Prior Publication Data

US 2019/0075907 A1 Mar. 14, 2019

(51) Int. Cl.
*A47C 16/00* (2006.01)
*A45D 29/22* (2006.01)

(52) U.S. Cl.
CPC ..... *A45D 29/22* (2013.01); *A47C 16/00* (2013.01)

(58) Field of Classification Search
CPC ..... A45D 29/22; A45D 31/00; A45D 29/00; A45D 29/001; A45D 29/17; A45D 29/18; A47C 16/00
USPC ..... 248/118, 118.1, 118.5; 132/73, 285, 132/76.5, 73.5; 206/581, 823
See application file for complete search history.

(56) References Cited

U.S. PATENT DOCUMENTS 915,047 A 3/1909 Fitzgerald
2,291,125 A * 7/1942 Wilkinson ..... A45D 29/22 132/73
2,561,001 A 7/1951 Ward
4,332,263 A 6/1982 Kitrell
4,915,331 A 4/1990 Becker
D309,356 S 7/1990 Johns
4,991,908 A * 2/1991 Krechel ..... A47C 16/02 108/132
5,081,936 A * 1/1992 Drieling ..... B60N 3/002 108/25
5,169,103 A * 12/1992 Jimenez ..... A45D 29/18 132/73
5,184,795 A 2/1993 Sexton
5,195,705 A * 3/1993 Kline ..... G02B 21/24 248/118

(Continued)

OTHER PUBLICATIONS

Barr, Ann E. et al., Work-Related Musculoskeletal Disorders of the Hand and Wrist: Epidemiology, Pathophysiology, and Sensorimotor Changes, J Orthop Sports Phys Ther. Oct. 2004, pp. 610-627.

(Continued)

*Primary Examiner* — Nkeisha Smith
(74) *Attorney, Agent, or Firm* — Quinn IP Law

(57) ABSTRACT

An apparatus to support forearm, guide wrist, cradle and elevate hand to the proper height, position fingers and prevent movement of patron for a nail technician to maintain proper posture while performing a nail service. The apparatus comprises an angled ramp and a platform, supported by legs connected to the underside of surfaces. The angled ramp comprises a bottom edge that is wider than top edge, connected by two equal length sides with a wrist support on each side near top edge. The platform comprises a bottom edge that meets the top edge of the angled ramp. Top edge is more narrow than bottom edge and scalloped in the center with two hand supports located on each side, connected by two equal length sides. The invention is made of polymer but not limited to being produced in other materials such as rubber, aluminum, other metals or forms of plastic.

20 Claims, 6 Drawing Sheets

(56) References Cited

U.S. PATENT DOCUMENTS 5,326,056 A * 7/1994 Smith ..... A45D 29/22 132/73
5,398,704 A * 3/1995 Dombeck ..... A45D 29/004 132/285
5,464,292 A * 11/1995 Grant ..... B41J 5/10 248/118.1
D373,445 S 9/1996 Wright-Godley
5,678,800 A * 10/1997 Markussen ..... G06F 3/0395 248/118
D400,304 S 10/1998 Stankovic
5,892,499 A * 4/1999 Vulk, Jr. ..... A47B 21/0371 248/118
D446,353 S 8/2001 Crary
6,276,647 B1 * 8/2001 Stopper ..... A45D 29/22 132/73
6,300,941 B1 * 10/2001 Segalle ..... G06F 3/03543 345/163
6,402,100 B1 * 6/2002 Rice ..... A47B 21/0371 248/118
6,726,158 B2 * 4/2004 Issa ..... G05G 1/58 248/118.1
6,951,325 B2 * 10/2005 Lopez-Apodaca ..... A47B 21/0371 248/118
6,957,612 B2 * 10/2005 Conlee ..... A47B 23/002 108/43
7,066,547 B1 * 6/2006 Russell ..... A47C 9/002 108/115
D734,545 S 7/2015 Cantu
9,192,219 B2 11/2015 Le
D777,488 S * 1/2017 Stanfield ..... D6/700
9,814,293 B2 * 11/2017 Houlder ..... A45D 29/00
2004/0234319 A1 * 11/2004 Lee ..... A47B 21/0314 400/714
2005/0218271 A1 * 10/2005 Jang ..... G06F 3/0395 248/118
2014/0083336 A1 * 3/2014 Hudd ..... A47B 21/0371 108/43
2015/0201731 A1 7/2015 Le

OTHER PUBLICATIONS

Fedorczyk, Jane M. et al., Exposure dependent increases in IL-1 beta, Substance P, CTGF and tendinosis in flexor digitorum tendons with upper extremity repetitive strain injury, J Orthop Res. Mar. 2010, pp. 298-307.

Harris, Carisa, 1st Place, PREMUS 1 best paper competition: workplace and individual factors in wrist tendinosis among blue-collar workers—the San Francisco study, Scand J Work Environ Health, Mar. 2011, pp. 85-98.

Laulan, Jacky, Thoracic outlet syndrome: definition, aetiological factors, diagnosis, management and occupational impact, J Occup Rehabil, Sep. 2011, pp. 366-373.

http://www.assh.org/handcare/hand-arm-conditions/cubital-tunnel accessed on Jul. 16, 2018, Cubital Tunnel Syndrome, American Society for Surgery of the Hand, 2015.

https://www.mayoclinic.org/diseases-conditions/wrist-pain/symptoms-causes/syc-20366213 accessed on Jul. 16, 2018, Wrist Pain, Mayo Clinic, Oct. 26, 2017.

https://www.mayoclinic.org/diseases-conditions/tennis-elbow/symptoms-causes/syc-20351987, accessed on Jul. 16, 2018, Tennis Elbow, Mayo Clinic, Mar. 6, 2018.

* cited by examiner

ERGONOMIC MANICURING SUPPORT

TECHNICAL FIELD

The present invention relates to a specially adapted manicuring support.

BACKGROUND OF THE INVENTION

The nature of a nail technician's job requires them to work long hours in an unnatural bent over position. Nail technicians are prone to repetitive use injuries due to improper body posture and improper alignment of their head in relation to their shoulders, and extra strain on their wrist, hand, fingers, neck, and back. The strain is created during a nail service when the patron, using their arm and hand, applies pressure downward on the nail technician or twists their hand requiring the nail technician to use force to hold in the hand in correct position. Strain exists when manipulating the patron's stiff fingers and struggling to keep the patron hand in one central location.

The nail technician is required to manipulate the fingers and hands to perform the service. During this time the patron's arm may become fatigued causing them to rest it on the table. The nail technician is unable to work properly with the forearm rested on the nail table. When the nail technician has to push or pull the hand into the proper position, they become very fatigued. When the nail technician has to lift the hand and arm from the nail table, to maintain proper height of the nails, they become very fatigued. When the patron's arm is not at a proper height where the wrist can bend downward, and the fingers can hang in a neutral position, it causes the nail technician to lean too far forward to see the nails to perform their work. The nail technician requires a patron's fingers to remain relaxed.

However, quite the contrary occurs during a nail service, when a patron does not have the proper support of the arm, wrist, and hand the following problems occur. 1) The patron attempts to hold their hand and fingers in a fixed position causing the fingers to be rigid and stiff and unable to relax the fingers. 2) The patron pulls their hand backward out of ideal view or pushes their hand forward out of the ideal position for the nail technician causing the nail technician to bend their neck at an uncomfortable angle. 3) The constant reminders to the patron from the nail technician to maintain proper positioning elongate the nail service causing the nail technician to take more time to perform the service.

It is important for the longevity of a nail technician's career they remain in an upright position with their head over their shoulders. It is important not to have the extra weight of a patron's hand and arm causing the wrist and arm of the nail technician to become fatigued. When a nail technician has to lean too far forward, causing the head to become misaligned from the shoulders, or support the extra weight and pressure of a patron's arm and hand, it may cause pain and strain in the back and neck and repetitive use injuries. These injuries include Tendinosis, the inflammation of the tendon and results from micro-tears that happen when the musculotendinous unit is acutely overloaded with a tensile force that is too heavy and/or too sudden.

Tendinosis, as defined by the National Center for Biotechnology Information of the National Institute of Health, is a degeneration of the tendon's collagen in response to chronic overuse; when overuse is continued without giving the ten-don time to heal and rest, such as with repetitive strain injury, tendinosis is the results. Thoracic Outlet Syndrome is compression of nerves and vessels during their passage through the cervicothoracic-cobrachial region. Neck and shoulder symptoms are reported by subjects to the National Center for Biotechnology Information of the National Institute of Health in certain occupations and are related to repetitive movements, and certain working positions, particularly in occupations requiring the use of the arms in elevation (barbers, switchboard operators, assembly lines, etc.), with the head or shoulders flexed anteriorly.

Cubital Tunnel Syndrome, as defined by the American Society for Surgery of the Hand, is a condition that involves pressure or stretching of the ulnar nerve (also known as the "funny bone" nerve), which can cause numbness or tingling in the ring and small fingers, pain in the forearm, and/or weakness in the hands. Carpal Tunnel Syndrome, is a condition that causes numbness, tingling and other symptoms in the hand and arm. Carpal tunnel syndrome, as defined by the Mayo Clinic, is caused by a compressed nerve in the carpal tunnel, a narrow passageway on the palm side of your wrist. The anatomy of your wrist, health problems and possibly repetitive hand motions can contribute to carpal tunnel syndrome. Tennis Elbow, as defined by the Mayo Clinic, is a painful condition that occurs when tendons in your elbow are overloaded, usually by repetitive motions of the wrist and arm.

People have been trying to solve the proper hand positioning dilemma of patrons while receiving a nail service for a very long time. The devices currently employed to support the forearm, wrist, and hand of a patron while receiving a nail service have one or more of the following ergonomic flaws. 1) The support device does not provide the proper angle to prevent the patron from applying downward pressure on the wrist 2) The support device does not have the proper height to allow the nail technician to maintain proper body alignment or prevent the patron from stiffening their fingers.

3) The support device does not have the proper height from the table top for the nail technician to work on the fingers and hand. 4) The support device does not provide clearance from the device for the nail technicians hand to hold the patron's fingers comfortably. No clearance causes the nail technicians hand to come into contact with the device while trying to work. 5) The support device is not made of a durable material. 6) The support device is not made of a material that can be sanitized.

7) The device is not wide enough to allow the elbow of the patron to rest comfortably on the table cushion and lay the forearm of each arm on a device. The device has to be moved several times during a service. 8) The support devices do not prevent the patron from pulling their hand backward, pushing their hand forward, lowering, raising or twisting their hand. 9) The support devices do not provide comfort for the patron. The following prior art comprises one or more of the previously stated deficiencies.

1) Stopper, U.S. Pat. No. 6,276,647 B1 issued on Aug. 21, 2001, reveals a structure for the wrist to rest. 2) Becker, U.S. Pat. No. 4,915,331 issued on Apr. 10, 1990, demonstrates an apparatus to work on the nails. 3) Caldwell, U.S. Pat. No. 9,192,219 issued on Nov. 24, 2015, provides a support device for the wrist. 4) Sexton, U.S. Pat. No. 5,184,795 issued on Feb. 9, 1993, shows a stand for the patron elbow and palm. 5) Cantu and Mullarkey, U.S. Pat. No. D734,545 S issued on Jul. 14, 2015, provides an ornamental design for hand support. 6) Lundeen, U.S. Pat. No. 20110133042 A1 issued on Jun. 9, 2011, reveals an armrest for manicures. 7) Jimenez and Hodges, U.S. Pat. No. 5,169,103 A issued on Dec. 8, 1992, maintains a stand to support a patrons hand in suspension. 8) Smith, U.S. Pat. No. 5,320,056 issued on Jul.

5, 1994, Claims a means for supporting hands wrists and forearms of manicurist and patron. 9) Baker and Plant, U.S. Pat. No. D734,546 S issued on Jun. 14, 2015, demonstrates the ornamental design for a hands support.

BRIEF SUMMARY OF THE INVENTION

The invention allows for the ergonomic support and positioning of a patron arm, wrist, and hand while receiving a nail service. The invention exists for the benefit of the nail technician and consequently the comfort of the patron. The invention provides a platform for the arm, wrist, and palm to rest comfortably while receiving a nail service eliminating the need to hold the hand and arm in a fixed position and prevents unwanted movement of the patron arm and hand. The invention may reduce the risk of repetitive use injuries for a nail technician caused by working long hours at a nail table and increase the longevity of a nail technician's career.

The Objects of the invention are as follows: 1) To provide the proper height and angle of a patron's forearm, wrist, hand, and position the fingers for a nail technician to work efficiently. 2) To eliminate the weight and pressure of a patron's arm and hand from a nail technicians body and eliminate unwanted patron hand movement. 3) To create the proper positioning of a patron during a nail service to allow the nail technician to maintain proper body posture. 4) To keep the patron in one central location, and decrease the length of time a nail service requires. 5) To prevent repetitive use injuries caused by working long hours in a fixed, unnatural, bent over position to extend the career of a nail technician.

The present invention solves the deficiencies named in the description of related art, as well as other insufficiencies associated with the related art. 1) One aspect of the invention is the angle and length of the ramp surface and wrist support, on which the forearm rests. When the wrist is placed higher than the elbow, it prevents the patron from applying downward pressure on the wrist. 2) The invention allows for the ergonomic positioning of the patron forearm, wrist, and hand to allow the fingers to hang for the nail technician to see the nails properly. The invention has wrist support guides, and hand supports that are the proper height from the table top. The correct height allows the nail technician to sit upright with proper body posture and see the hand and fingers properly to perform a nail service. Proper finger position allows the technician to maneuver the fingers and hand according to their needs while maintaining proper body posture to reduce the risk of receptive use injuries.

3) The invention has the proper height from the table top which allows the clearance needed to grasp the patron's fingers while the fingers hang in a downward position. 4) The invention has an opening that provides clearance under the platform, the nail technicians hand or fingers do not collide with the invention while attempting to hold onto the patron's fingers. 5) The invention is made of a high impact material that is durable and will not bend or break in half. 6) The invention is made of a solid non-porous material that may be sanitized in between patrons. 7) The invention is wide enough the patron can rest the left arm and the right arm without having to move the invention from side to side or have the patron continually reposition their arm or body.

8) The invention has a hand support that cradles the patron's palm preventing the patron from pulling their hand backward, pushing their hand forward or twisting their hand eliminating unwanted movement by the patron. 9) The ergonomic angle of the invention provides comfort for the forearm, wrist, and hand of the patron. The depth of the invention allows the wrist and palm to rest comfortably and fingers to hang downward eliminating the need of the patron to hold the fingers up or in a fixed position. The invention is wider at the bottom where the forearm meets the elbow and more narrow where the fingers of the patron hang off the platform mimicking the shape of an isosceles trapezoid. The angle allows the patron to sit comfortably with elbows shoulder width apart. 10) The legs of the invention are located equal distance from the edge of the platform and ramp, running parallel to the sides of the invention. This positioning provides a solid base and prevents tipping.

BRIEF DESCRIPTION OF THE DRAWINGS

The aspects of the invention will become apparent in the drawings and the detailed description accompanying the drawings.

DETAILED DESCRIPTION OF THE INVENTION

Figure 1:
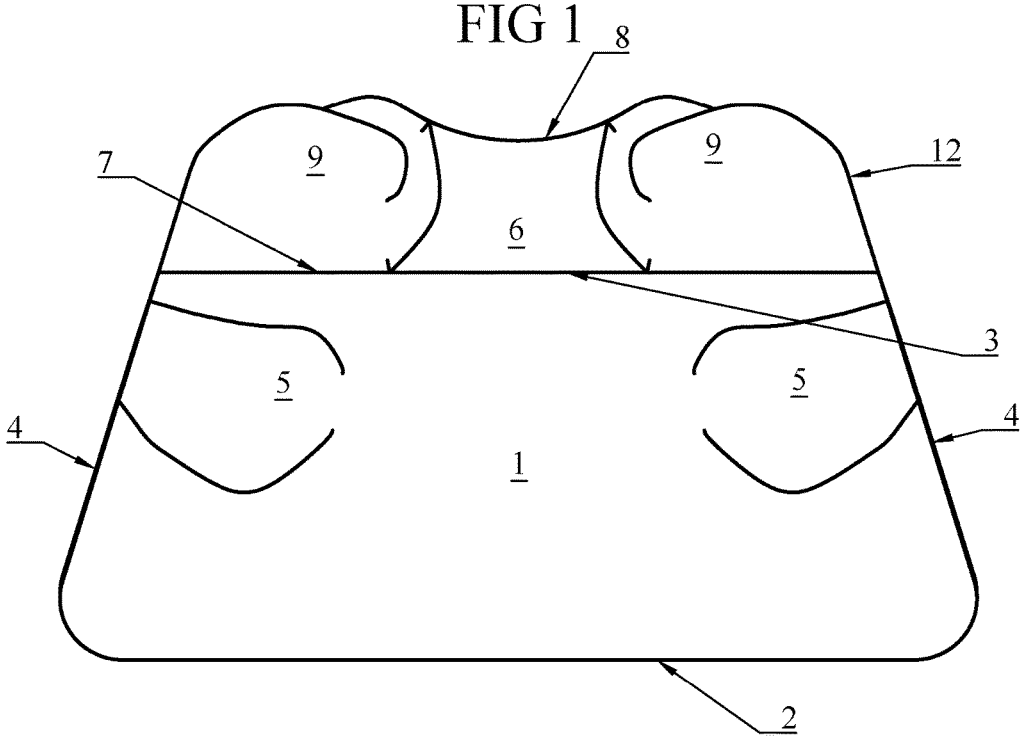
FIG. 1 is a top view of the exemplary embodiment of the invention. It shows the width at the bottom edge of the angled ramp is wider than the top edge of the platform mimicking an isosceles trapezoid. The wrist support guides are located on the angled ramp surface. The contoured hand supports are located on the platform surface.

It is to be recognized that the invention is not limited in its application, to the details of construction or the arrangement of components described in the following or illustrated in the drawings. The invention is fitted of other representations and being practiced or of being carried out in various ways such as angle, height, width and depth adjustments.

The exemplary embodiment of the present invention provides a support apparatus adapted for decreasing repetitive use injuries of nail technicians by improving the ergonomic support for the forearm, hand, wrist, and location of a user or patron's fingers while receiving a nail service. The apparatus is portable and lightweight, eliminates the weight and strain imposed on a nail technician's body by the weight of a patron arm and hand and force created by a patron, and allows the nail technician to maintain proper body posture during a nail service.

A nail technician places the invention on the nail table in front of the patron. The patron places their forearm on the angled ramp surface, rests the wrist on the wrist support guide, and places the palm of the hand on the hand support so the fingers are able to hang in a downward position. The nail technician is now able to work on the fingers without the excess weight of the patron arm and hand, while maintaining proper body position. The exemplary embodiment provides a comfortable area for the patron to rest the arm and hand eliminating fatigue and the need to hold the hand and fingers in a fixed position. The exemplary embodiment also prevents the patron from pulling their hand backward, pushing it forward, pressing it down or twisting the hand.

The exemplary embodiment allows the nail technician to keep the fingers in one location eliminating time previously required to place the patron hand in a position where they are able to work. Keeping the patron hand in one location allows the nail technician to save time when completing each service. The exemplary embodiment is shown in FIGS. 1-8. The exemplary embodiment may be injection molded or blow molded. However, the exemplary embodiment is manufactured by an SLA 3-D printer. The second embodiment is shown in FIGS. 9-14. The third embodiment is shown in FIGS. 15-20. The invention is not limited to be manufactured in other materials such as rubber, aluminum other plastics or other metals or other methods of manufacturing.

Referring now to FIG. 1, this top view of the exemplary embodiment consists of an angled ramp 1 configured to receive and support a forearm and wrist of a user or patron that meets a platform 6 configured to receive and support a hand of the user. The angled ramp 1 and platform 6 are supported by legs. The bottom edge of the platform 7 meets the top edge 3 of the angled ramp 1. The patron's forearm rests on the angled ramp 1 while the wrist rests on at least one wrist support guide 5 to provide comfort as well as keep their arm in the position intended.

The patron's palm rests on the at least one contoured hand support 9 located on the platform 6. The at least one hand support 9 is contoured for the hand to rest comfortably. The fingers of the patron hang over the edge of the hand support 9 allowing the nail technician to work efficiently. The bottom edge 2 of the angled ramp 1 is longer than the top edge 3 of the angled ramp 1 allowing the patron to sit with their elbows and shoulder width apart. The opposing first and second side edges 4 of the angled ramp 1 are of equal length and extend between the bottom edge 2 and the top edge 3. The bottom edge 2, top edge 3 and opposing side edges 4 of the angled ramp 1 form an angled ramp surface that resembles the shape of an isosceles trapezoid.

The bottom edge of the platform 7 is longer than the top edge of the platform 8. The opposing side edges of the platform 12 are of equal length and extend between the bottom edge and the top edge. The bottom edge, top edge and opposing side edges 12 of the platform 6 form a platform surface that resembles the shape of an isosceles trapezoid. The platform 6 and the angled ramp 1 cooperate to form a unitary isosceles trapezoid shaped surface when the bottom edge 7*b* of the platform 6 is connected to the top edge 3 of the angled ramp 1.

Figure 2:
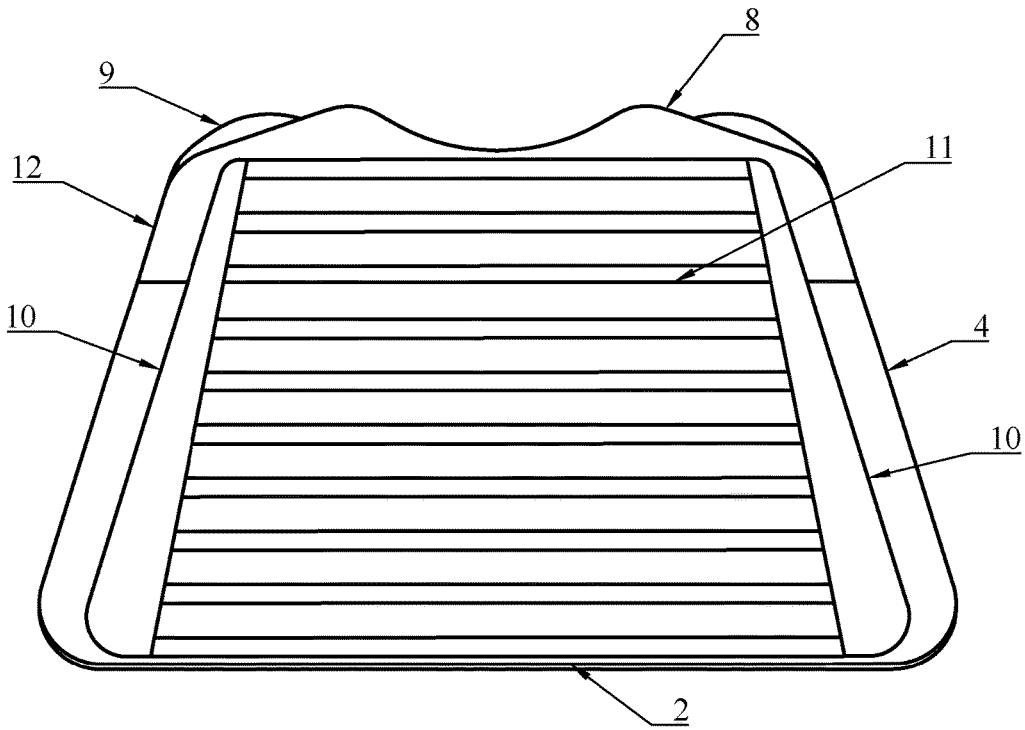
FIG. 2 is a bottom view of the exemplary embodiment of the invention. It shows the leg positions relative to the outer edge of the invention. The leg position allows the platform area to overhang and the angled ramp area to overhang. The angle of the leg position prevents tipping. This exemplary embodiment shows the support brackets on the underside of the invention providing strength and durability.

Referring now to FIG. 2, this bottom view of the exemplary embodiment shows the leg 10 positions relative to the outer edge 4 of the angled ramp 1 and the outer edge 12 of the platform 6 of the invention. The leg 10 position allows the top edge 8 of the platform area 6 to overhang allowing clearance for the nail technician fingers and the bottom edge 2 of the angled ramp 1 to overhang to allow clearance for a cushion on a nail table. The angle of the leg 10 position prevents tipping. This exemplary embodiment shows the support brackets 11 on the underside of the invention providing strength and durability for structural reinforcement of the angled ramp 1 and platform 6.

Figure 3:
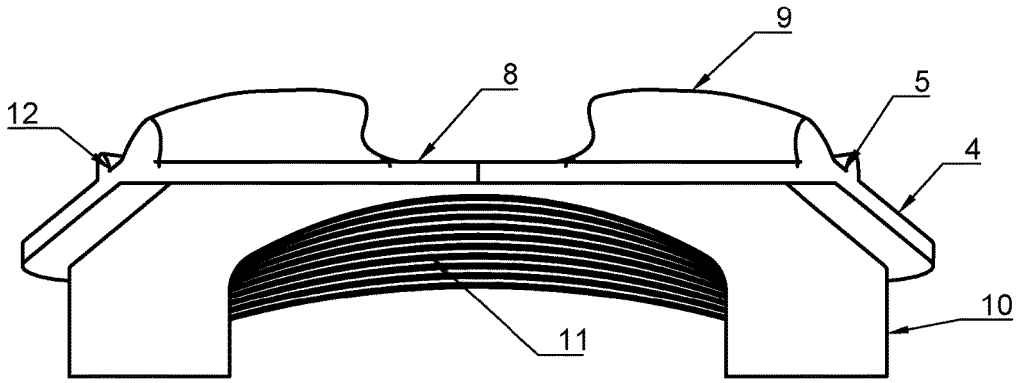
FIG. 3 is a back view of the exemplary embodiment of the invention. It shows the overhang the hand supports create allowing the fingers to hang in a downward position. It shows the clearance under the platform that allows the nail technician to maneuver the fingers to work efficiently. It shows the distance of the legs from the outer edge of the invention. It shows the edge of the wrist support guide located on the ramp and the brackets on the underside of the invention for support.

Referring now to FIG. 3, this back view of the exemplary embodiment shows the clearance under the platform that allows the nail technician to maneuver the fingers to work efficiently. The at least one hand support 9 includes a pair of hand supports 9 located proximate each side edge 12 of the platform 6. A first contoured hand support 9 is disposed proximate a first side edge of the platform 6 and a second contoured hand support 9 is disposed proximate an opposing second side edge of the platform 6. The contoured convex portion of the overhang the hand supports 9 engages the palm of the hand of the user or patron and allows the patron's fingers to hang in a downward position. The distance of the legs 10 from the outer edge of the invention. The edge of the wrist support guide 5 located on the angled ramp and the brackets 11 on the underside of the invention for support.

Figure 4:
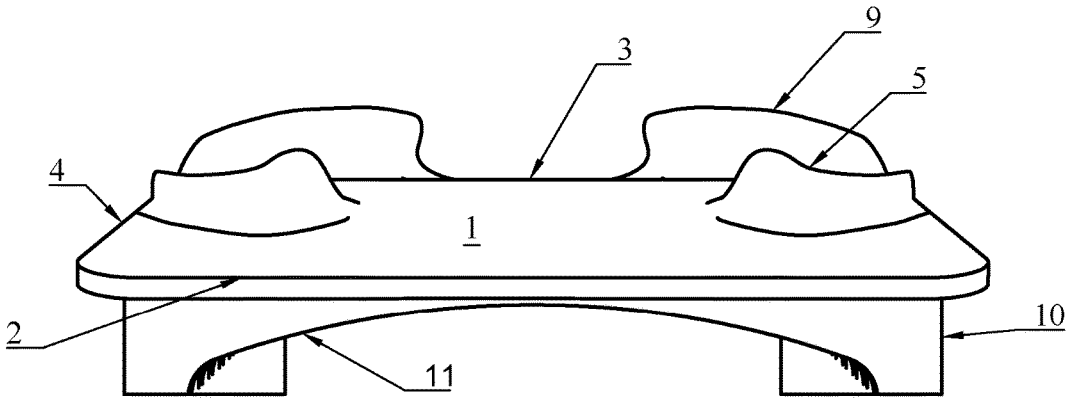
FIG. 4 is a front view of the exemplary embodiment of the invention. It shows the attachment of the brackets to the legs of the invention. It shows the angle of the ramp for the forearm to rest. It shows the platform area is horizontal to the table top the invention rests. It shows the wrist support guides are located near the top on the angled ramp area, and the contoured hand supports located on the platform area.

Referring now to FIG. 4, this front view of the exemplary embodiment shows the front view of the invention. The top edge 3 of the angled ramp 1 is the same width as the bottom edge of the platform and shows the platform is horizontal to the table top the invention rests. The hand supports 9 are located on each side of the platform. This view shows the angle of the angled ramp 1 for the forearm to rest. The mist support guides 5 are located on each side of the angled ramp area near the top. The outer edge 4 of the angled ramp 1 are equal length. This view shows the attachment of the brackets 11 to the legs 10 of the invention.

Figure 5:
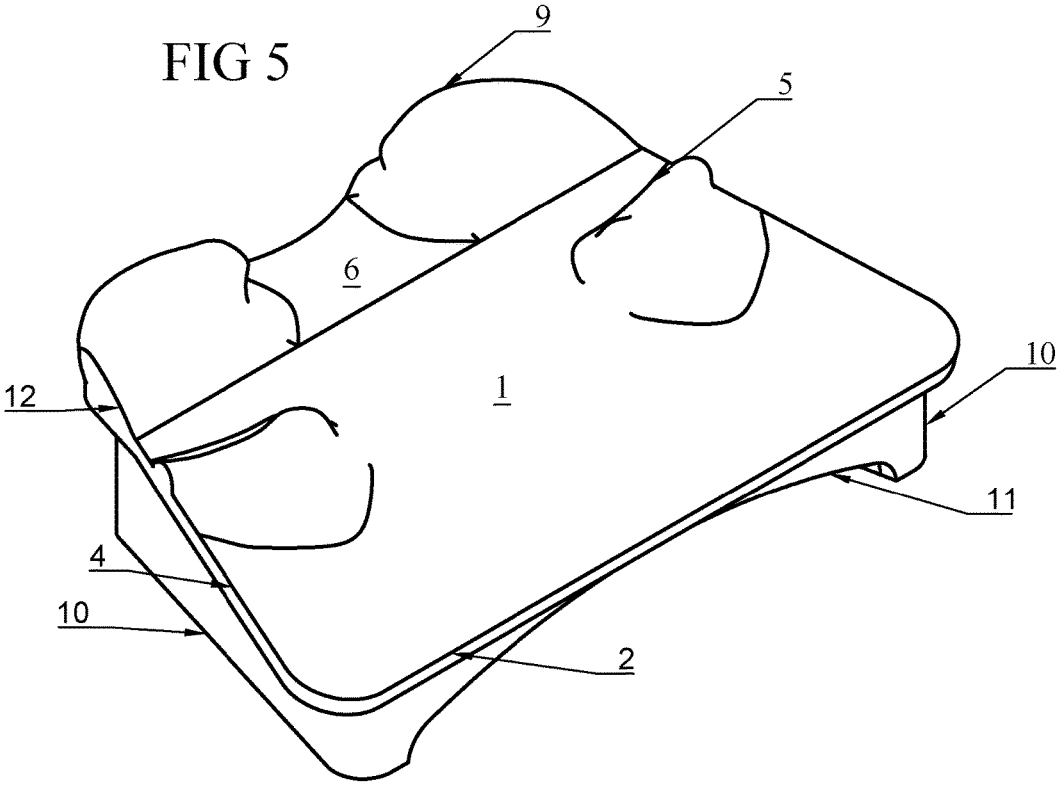
FIG. 5 is an isometric view of the exemplary embodiment of the invention. It shows the front edge, of the angled ramp, overhangs the support bracket connecting the legs. It shows the outer edge of the invention is parallel to the legs. It shows the wrist support guides located near the top of the angled ramp of the invention. It shows the hand supports located on the platform area of the invention.

Referring now to FIG. 5, this isometric view of the exemplary embodiment shows the bottom edge 2 of the angled ramp 1 overhangs the support bracket 11 connecting the legs. This overhang allows for the invention to be pushed up to a cushioned arm rest on the table top. The outer edge 4 of the platform and the outer edge 12 of the angled ramp are parallel to the legs 10. This provides a sturdy base and prevents tipping if pressure is applied to the corners of the invention. At least one wrist support guide 5 is located on at least one side of the angled ramp 1. The at least one wrist support guide 5 prevents the patron from angling their elbow out too far or moving their arm too far to the center of the invention. The hand supports 9 are located on each side of the platform 6 area of the invention. The hand supports 9 cradle the palm of the hand and has a countered area for the thumb to rest comfortably. The fingers hang over the end of the hand support 9.

Figure 6:
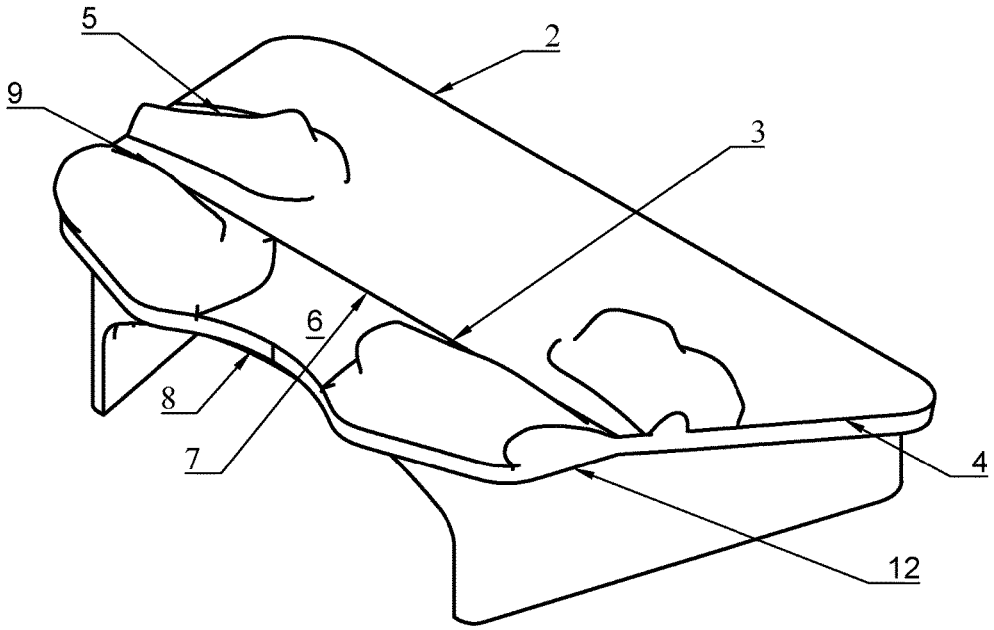
FIG. 6 is an isometric view of the exemplary embodiment of the invention. It shows the isosceles trapezoid shape of the apparatus and the scalloped front edge of the platform. It shows the bottom edge of the platform area is connected to the top edge of the angled ramp area of the invention. It shows wrist support guides located near the top of the angled ramp area and the contoured hand support guides on each side of the platform area of the invention. It shows the bottom edge of the angled ramp area is wider than the top edge of the platform area of the invention.

Referring now to FIG. 6, this isometric view of the exemplary embodiment shows the isosceles trapezoid shape of the invention and the scalloped top edge 8 of the platform 6. The bottom edge 7 of the platform 6 is connected to the top edge 3 of the angled ramp 1. The opposing side edges 4 of the angled ramp 1 are equal length. The opposing first and second side edges 12 of the platform 6 are equal length. A pair of opposing wrist support guides 5 are located proximate each of the opposing side edges 4 of the angled ramp 1 near the top edge 3. A first wrist support guide 5 is disposed proximate the first side edge of the angled ramp 1 and a second wrist support guide 5 is disposed proximate the opposing second side edge of the angled ramp 1. A pair of opposing hand support guides 9 are located proximate each of the opposing side edges 12 of the platform 6. The opening in-between the opposing wrist support guides 5 and the opposing hand supports 9 create an opening for the arm and hand to lay in order to perform any nail service or give a hand massage.

Figure 7:
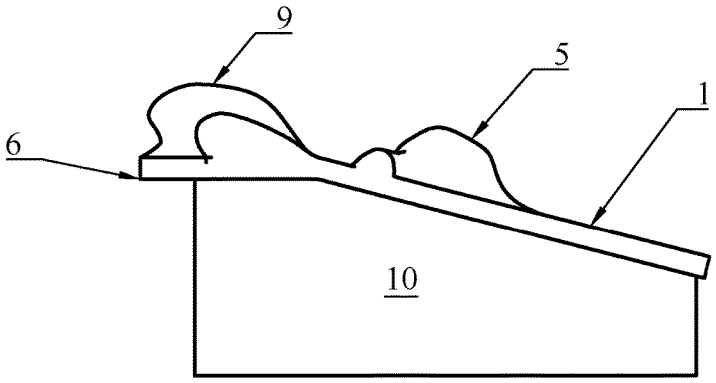
FIG. 7 is a side view of the exemplary embodiment of the invention. It shows the horizontal platform surface and the angled ramp surface supported by legs of the invention. It shows the wrist support guide is located near the top of the angled ramp and contoured hand support is located on the platform area of the invention.

Referring now to FIG. 7, this side view of the exemplary embodiment shows the horizontal platform 6 surface and the angled ramp 1 surface supported by legs 10 of the invention. The wrist support guide 5 is located near the top of the angled ramp 1 and hand support 9 is located on the platform 6 area of the invention. The angle of the angled ramp 1 provides a comfortable place for the patron the rest the arm and prevents the patron from applying downward pressure on the wrist or resting the arm on the table.

Figure 8:
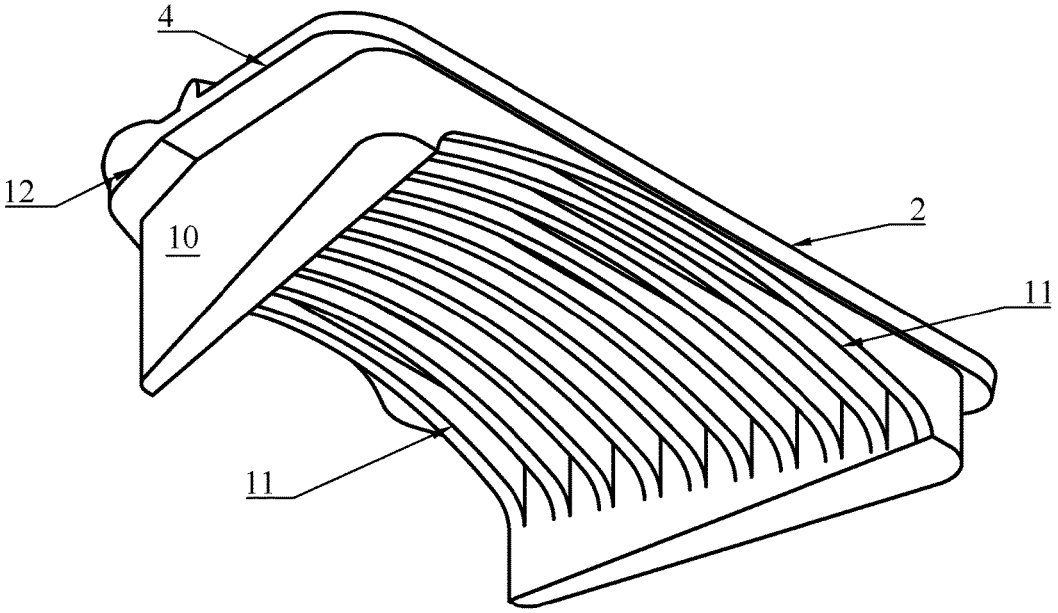
FIG. 8 is an alternative view of the exemplary embodiment of the invention. It shows the support brackets on the underside of the invention, the distance the legs are from the outer edges of the angled ramp area and the platform area of the invention.

Referring now to FIG. 8, this angled bottom view of the exemplary embodiment shows the support brackets 11 on the underside of the invention, the distance the legs 10 are from the outer edges 4 of the angled ramp 1 and the outer edge 12 of the platform of the invention. The view of the underside of the brackets 11 show where they connect to the legs 10.

This second embodiment of the present invention provides a support apparatus adapted for decreasing repetitive use injuries of nail technicians by improving the ergonomic support for the forearm, hand, wrist, and location of a patrons fingers while receiving a nail service. The apparatus is portable and lightweight and eliminates the weight and strain imposed on a nail technician's body by a patron. A nail technician places the invention on the nail table in front of the patron. The patron places their forearm on the angled ramp surface, places the palm of the hand on the hand support so the fingers are able to hang in a downward position. The nail technician is now able to work on the fingers without the excess weight of the patron arm and hand, while maintaining proper body position.

The second embodiment provides a comfortable area for the patron to rest the arm and hand eliminating fatigue and the need to hold the hand and fingers in a fixed position. The second embodiment also prevents the patron from pulling their hand backward, pushing it forward, pressing it down or twisting the hand. The second embodiment allows the nail technician to keep the fingers in one location eliminating time previously required to place the patron hand in a position where they are able to work. Keeping the patron hand in one location allows the nail technician to save time when completing each service. The second embodiment is shown in FIGS. 9-14. The second embodiment may be injection molded or blow molded. However, the second embodiment is manufactured by an SLA 3-D printer. The invention is not limited to be manufactured in other materials such as rubber, aluminum other plastics or other metals or other methods of manufacturing.

Figure 9:
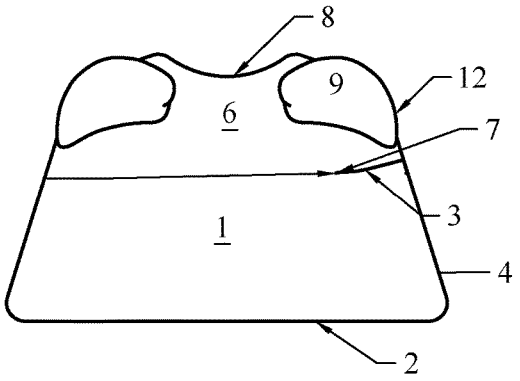
FIG. 9 is a top view of the second embodiment of the invention. It shows the width at the bottom edge of the angled ramp is wider than the top edge of the platform mimicking an isosceles trapezoid. The contoured hand supports are located on the platform surface.

Referring now to FIG. 9, this top view of the second embodiment consists of an angled ramp 1 that meets a platform 6 supported by legs. The bottom edge of the platform 7 meets the top edge of the angled ramp 3. The patron's forearm rests on the angled ramp 1. The patron's palm rests on the con-toured hand supports 9 located on the platform 6. The hand support 9 is contoured for the hand to rest comfortably. The fingers of the patron hang over the edge of the hand supports 9 allowing the nail technician to work efficiently. The bottom edge 2 of the angled ramp 1 is longer than the top edge 3 of the angled ramp 1 allowing the patron to sit with their elbows shoulder width apart. The outer edge 4 of the angled ramp 1 are equal length. The angled ramp 1 resembles the shape of an isosceles trapezoid. The bottom of the platform 7 is longer than the top edge of the platform 8. The outer edges 12 of the platform 6 are equal length. The platform 6 resembles the shape of an isosceles trapezoid.

Figure 10:
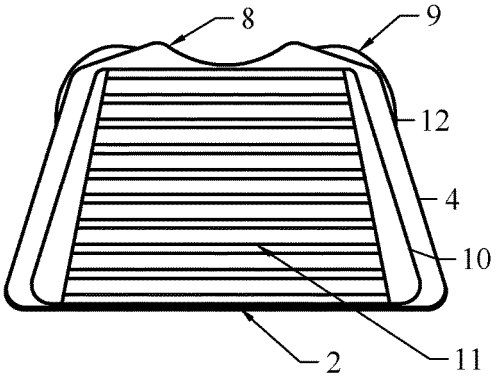
FIG. 10 is a bottom view of the second embodiment of the invention. It shows the leg positions relative to the outer edge of the invention. The leg position allows the platform area to overhang and the angled ramp area to overhang. The angle of the leg position prevents tipping. It shows the support brackets on the underside of the invention providing strength and durability.

Referring now to FIG. 10, this bottom view of the second embodiment shows the leg 10 positions relative to the outer edge 4 of the angle ramp 1 and the outer edge 12 of the platform 6 of the invention. The leg 10 position allows the top edge 8 of the platform area 6 to overhang allowing clearance for the nail technician fingers and the bottom edge 2 of the angled ramp area 1 to overhang to allow clearance for a cushion on a nail table. The angle of the leg 10 position prevents tipping. This second embodiment shows the support brackets 11 on the underside of the invention providing strength and durability.

Figure 11:
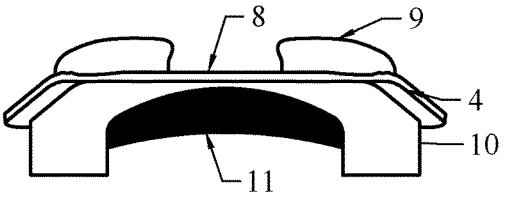
FIG. 11 is a back view of the second embodiment of the invention. It shows the overhang the hand supports create allowing the fingers to hang in a downward position. It shows the clearance under the platform that allow the nail technician to maneuver the fingers to work efficiently. It shows the distance of the legs from the outer edge of the invention.

Referring now to FIG. 11, this back view of the second embodiment shows the clearance under the platform that allows the nail technician to maneuver the fingers to work efficiently. The hand supports 9 are located on each side of the platform 6. The overhang the hand supports 9 create allowing the fingers to hang in a downward position. The distance of the legs 10 from the outer edge of the invention. The brackets 11 are on the underside of the invention for support.

Figure 12:
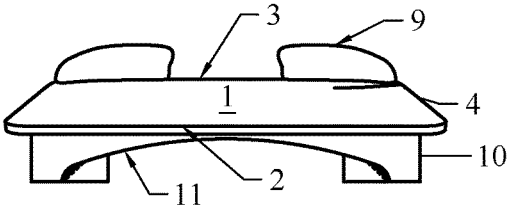
FIG. 12 is a front view of the second embodiment of the invention. It shows the attachment of the brackets to the legs of the invention. It shows the angle of the ramp for the forearm to rest. It shows the platform area is horizontal to the table top the invention rests and the contoured hand supports located on the platform area.

Referring now to FIG. 12, this front view of the second embodiment shows the top edge 3 of the angled ramp 1 is the same width as the bottom edge of the platform and shows the platform is horizontal to the table top the invention rests. The hand supports 9 are located on each side of the platform. This view shows the angle of the angled ramp 1 for the forearm to rest. The outer edge 4 of the angled ramp 1 are equal length. This view shows the attachment of the brackets 11 to the legs 10 of the invention.

Figure 13:
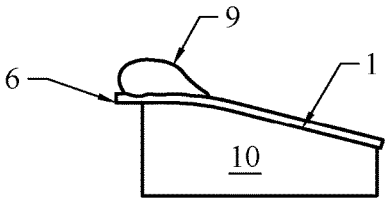
FIG. 13 is a side view of the second embodiment of the invention. It shows the horizontal platform surface and the angled ramp surface supported by legs of the invention. It shows the contoured hand support is located on the platform area of the invention.

Referring now to FIG. 13, this side view of the second embodiment shows the horizontal platform 6 surface and the angled ramp 1 surface supported by legs 10 of the invention. The hand support 9 is located on the platform 6 area of the invention. The angle of the angled ramp 1 provides a comfort-able place for the patron the rest the arm and prevents the patron from applying downward pressure on the wrist or resting the arm on the table.

Figure 14:
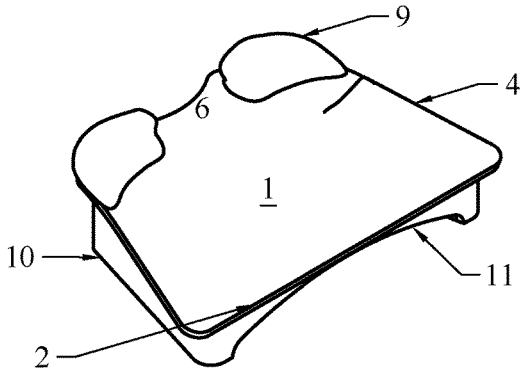
FIG. 14 is an alternative view of the second embodiment of the invention. It shows the support brackets on the underside of the invention, the distance the legs are from the outer edges of the angled ramp area and the platform area of the invention.

Referring now to FIG. 14, this alternative view of the second embodiment shows the isosceles trapezoid shape of the invention and the scalloped front edge 8 of the platform 6. The hand supports 9 are located on each of the platform 6. The legs 10 are connected by brackets 11 for supporting the angled ramp 1 and platform 6. The bottom edge 2 of the angled ramp 1 overhang the bracket 11 to allow the invention to push up against a cushion on a nail table. The opening in-between the hand support guides 9 create a space for the arm and hand to lay in order to perform any nail service or give a hand massage.

This third embodiment of the present invention provides a support apparatus adapted for decreasing repetitive use injuries of nail technicians by improving the ergonomic support for the forearm, hand, wrist, and location of a patrons fingers while receiving a nail service. The apparatus is portable and lightweight and eliminates the weight and strain imposed on a nail technician's body by a patron. A nail technician places the invention on the nail table in front of the patron. The patron places their forearm on the angled ramp surface, places the palm of the hand on the platform so the fingers are able to hang in a downward position. The platform is able to move from a horizontal position to an angled position and is connected to the angled ramp surface by a hinge.

The nail technician is now able to work on the fingers without the excess weight of the patron arm and hand, while maintaining proper body position. The third embodiment provides a comfortable area for the patron to rest the arm and hand eliminating fatigue and the need to hold the hand and fingers in a fixed position. The third embodiment also prevents the patron from pulling their hand backward, pushing it forward and pressing it down. The third embodiment allows the nail technician to keep the fingers in one location eliminating time previously required to place the patron hand in a position where they are able to work. Keeping the patron hand in one location allows the nail technician to save time when completing each service. The third embodiment is shown in FIGS. 15-20. The third embodiment may be injection molded or blow molded. However, the alternative embodiment 1 is manufactured by an SLA 3-D printer. The invention is not limited to be manufactured in other materials such as rubber, aluminum other plastics or other metals or other methods of manufacturing.

Figure 15:
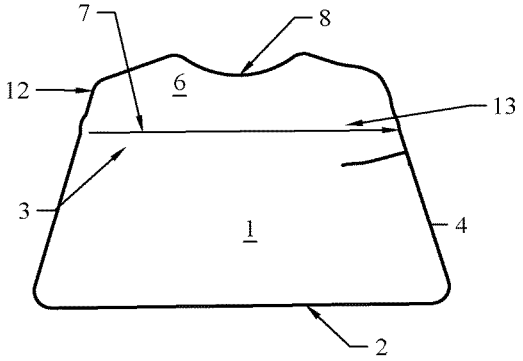
FIG. 15 is a top view of the third embodiment of invention. It shows the width at the bottom edge of the angled ramp is wider than the top edge of the platform mimicking an isosceles trapezoid. It shows where the top edge of the ramp and the bottom edge of the platform meet and are connected with a hinge. The hinge allows the platform surface to adjust from horizontal to a number of angles.

Referring now to FIG. 15, this top view of the third embodiment of the invention consists of an angled ramp 1 that meets a platform 6 supported by legs. The bottom edge of the platform 7 meets the top edge of the angled ramp 3 and is connected with a hinge 13. The patron's forearm rests on the angled ramp 1. The patron's palm rests on the platform 6. The fingers of the patron hang over the edge of the platform 6 allowing the nail technician to work efficiently. The bottom edge 2 of the angled ramp 1 is longer than the top edge 3 of the angled ramp 1 allowing the patron to sit with their elbows shoulder width apart. The outer edge 4 of the angled ramp 1 are equal length. The angled ramp 1 resembles the shape of an isosceles trapezoid. The bottom of the platform 7 is longer than the top edge of the platform 8.

The outer edges 12 of the platform 6 are equal length. The platform 6 resembles the shape of an isosceles trapezoid.

Figure 16:
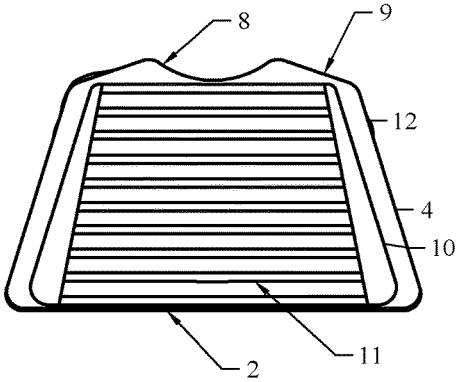
FIG. 16 is a bottom view of the third embodiment of the invention. It shows the leg positions relative to the outer edge of the invention. The leg position allows the platform area to overhang and the angled ramp area to overhang. The angle of the leg position prevents tipping. It shows the support brackets on the underside of the invention providing strength and durability.

Referring now to FIG. 16, this bottom view of the third embodiment shows the leg 10 positions relative to the outer edge 4 of the angled ramp 1 and the outer edge 12 of the platform 6 of the invention. The leg 10 position allows the top edge 8 of the platform area 6 to overhang allowing clearance for the nail technician fingers and the bottom edge 2 of the angled ramp area 1 to overhang to allow clearance for a cushion on a nail table. The angle of the leg 10 position prevents tipping. This third embodiment shows the support brackets 11 on the underside of the invention providing strength and durability.

Figure 17:
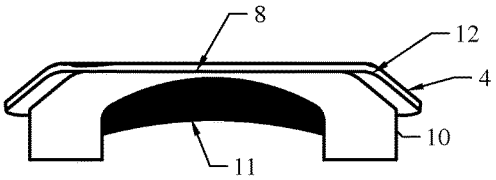
FIG. 17 is a back view of the third embodiment of the invention. It shows the overhang the platform creates allowing the fingers to hang in a downward position. It shows the clearance under the platform that allow the nail technician to maneuver the fingers to work efficiently. It shows the distance of the legs from the outer edge of the invention. It shows the brackets on the underside of the invention for support.

Referring now to FIG. 17, this back view of the third embodiment shows the clearance under the platform that allows the nail technician to maneuver the fingers to work efficiently. The overhang the platform 6 creates allowing the fingers to hang in a downward position. The distance of the legs 10 from the outer edge of the invention. The brackets 11 are on the underside of the invention for support.

Figure 18:
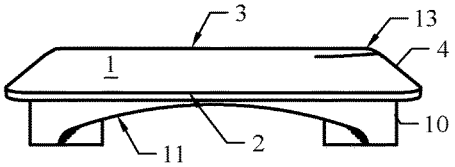
FIG. 18 is a front view of the third embodiment of the invention. It shows the attachment of the brackets to the legs of the invention. It shows the angle of the ramp for the forearm to rest. It shows the platform area is horizontal to the table top the invention rests. It shows where the top edge of the ramp and the bottom edge of the platform meet and are connected with a hinge. The hinge allows the platform surface to adjust from horizontal to a number of angles.

Referring now to FIG. 18, this front view of the third embodiment shows the top edge 3 of the angled ramp 1 is the same width as the bottom edge of the platform and shows the platform is horizontal to the table top the invention rests. The hinge 13 that connects the anger ramp 1 and the platform. This view shows the angle of the angled ramp 1 for the forearm to rest. The outer edge 4 of the angled ramp 1 are equal length. This view shows the attachment of the brackets 11 to the legs 10 of the invention.

Figure 19:
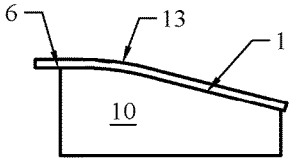
FIG. 19 is a side view of the third embodiment of the invention. It shows the horizontal platform surface and the angled ramp surface supported by legs of the invention. The platform surface is shown in a horizontal position but has the ability to change angles due to the hinge connecting the platform surface and the ramp surface.

Referring now to FIG. 19, this side view of the third embodiment shows the horizontal platform 6 surface and the angled ramp 1 surface connected by a hinge 13 supported by legs 10 of the invention. The angle of the angled ramp 1 provides a comfortable place for the patron to rest the arm and prevents the patron from applying downward pressure on the wrist or resting the arm on the table.

Figure 20:
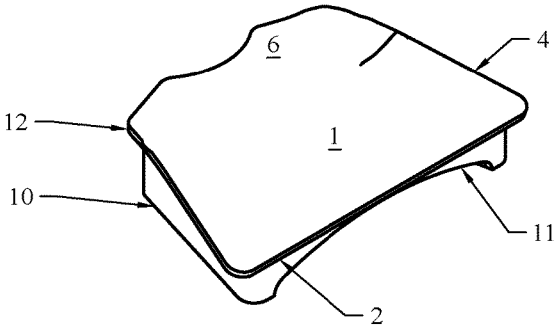
FIG. 20 is an alternative view of the third embodiment of the invention. It shows the support brackets on the underside of the invention, the distance the legs are from the outer edges of the angled ramp area and the platform area of the invention.

Referring now to FIG. 20, this alternative view of the third embodiment shows the isosceles trapezoid shape of the invention and the scalloped front edge 8 of the platform 6. The legs 10 are connected by brackets 11 for supporting the angled ramp 1 and platform 6. The bottom edge 2 of the angled ramp 1 overhang the bracket 11 to allow the invention to push up against a cushion on a nail table. The outer edge 4 of the angled ramp 1 are equal length. The outer edge 12 of the platform 6 are equal length.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment may be combined with one or a plurality of other desired characteristics from other embodiments, resulting in other embodiments not described in words or by reference to the drawings. Accordingly, such other embodiments fall within the framework of the scope of the appended claims.

The invention claimed is:

1. An ergonomic manicuring support apparatus comprising:

an angled ramp including a top edge, a bottom edge wider in length than the top edge and opposing side edges extending between the bottom edge and the top edge, wherein the angled ramp is configured to receive and support at least one forearm and at least one wrist of a user;

a platform including a top edge, a bottom edge wider in length than the top edge and connected to the top edge of the angled ramp and opposing side edges extending between the bottom edge and the top edge, wherein the platform is configured to receive and support at least one hand of the user;

at least one contoured convex hand support disposed proximate at least one opposing side edge of the platform, wherein the at least one contoured convex hand support is configured to support and prevent movement of the at least one hand of the user;

a pair of legs connected to and supporting the angled ramp and the platform, wherein the pair of legs are connected to a portion of the platform to allow the top edge of the platform to extend from the legs; and support brackets extending between the pair of legs to structurally reinforce the angled ramp and the platform, wherein the at least one forearm, wrist and hand of the user are positioned and supported by the angled ramp and at least one contoured convex hand support on the platform to elevate the at least one wrist and the at least one hand of the user and position one or more fingers of the user in a hanging downward position relative to the top edge of the platform to receive manicuring services.

2. The ergonomic manicuring support of claim 1 wherein the bottom edge, the top edge and the opposing side edges of the angled ramp form an isosceles trapezoid shaped angled ramp surface.

3. The ergonomic manicuring support of claim 1 wherein the bottom edge, the top edge and the opposing side edges of the platform form an isosceles trapezoid shaped platform surface.

4. The ergonomic manicuring support of claim 3 wherein the platform and the angled ramp cooperate to form a unitary isosceles trapezoid shaped surface when the bottom edge of the platform is connected to the top edge of the angled ramp.

5. The ergonomic manicuring support of claim 1 further comprising at least one wrist support guide disposed proximate at least one of the opposing side edges of the angled ramp, wherein the at least one wrist support guide is configured to support and position the at least one wrist of the user for the manicuring services.

6. The ergonomic manicuring support of claim 5 wherein the at least one wrist support guide further comprises a first wrist support guide disposed proximate a first side edge of the angled ramp and a second wrist support guide disposed proximate an opposing second side edge of the angled ramp.

7. The ergonomic manicuring support of claim 6 wherein the first wrist support guide cooperates with a first contoured convex hand support and the second wrist support guide cooperates with a second contoured convex hand support to define an opening therebetween.

8. The ergonomic manicuring support of claim 1 wherein the at least one contoured convex hand support further comprises a first contoured convex hand support disposed proximate a first side edge of the platform and a second contoured convex hand support disposed proximate an opposing second side edge of the platform.

9. The ergonomic manicuring support of claim 1 wherein the top edge of the platform further comprises a scalloped edge portion.

10. The ergonomic manicuring support of claim 1 wherein the legs are formed as a right trapezoid to support the angled ramp and platform to position the at least one forearm, wrist and hand of the user for manicuring services.

11. An ergonomic manicuring support apparatus comprising:

an angled ramp including a top edge, a bottom edge wider in length than the top edge and opposing side edges extending between the bottom edge and the top edge, wherein the angled ramp is configured to receive and support at least one forearm and at least one wrist of a user;

at least one wrist support guide disposed proximate at least one of the opposing side edges of the angled ramp, wherein the at least one wrist support guide is configured to support and guide the at least one forearm and the at least one wrist of the user;

a platform including a top edge, a bottom edge wider in length than the top edge and connected to the top edge of the angled ramp and opposing side edges extending between the bottom edge and the top edge, wherein the platform is configured to receive and support at least one hand of the user;

at least one contoured convex hand support disposed proximate at least one opposing side edge of the platform, wherein the at least one contoured convex hand support is configured to support and prevent movement of the at least one hand of the user;

a pair of legs connected to and supporting the angled ramp and the platform, wherein the pair of legs are connected to a portion of the platform to allow the top edge of the platform to extend from the legs; and support brackets extending between the pair of legs to structurally reinforce the angled ramp and the platform, wherein the at least one forearm, wrist and hand of the user are positioned and supported by one or more of the angled ramp, the at least one wrist support guide on the angled ramp, the platform and the at least one contoured convex hand support on the platform to elevate the at least one wrist and the at least one hand of the user and position one or more fingers of the user in a hanging downward position relative to the top edge of the platform to receive manicuring services.

12. The ergonomic manicuring support of claim 11 wherein the bottom edge, the top edge and the opposing side edges of the angled ramp form an isosceles trapezoid shaped angled ramp surface.

13. The ergonomic manicuring support of claim 11 wherein the bottom edge, the top edge and the opposing side edges of the platform form an isosceles trapezoid shaped platform surface.

14. The ergonomic manicuring support of claim 13 wherein the platform and the angled ramp cooperate to form a unitary isosceles trapezoid shaped surface when the bottom edge of the platform is connected to the top edge of the angled ramp.

15. The ergonomic manicuring support of claim 11 wherein the at least one wrist support guide further comprises a first wrist support guide disposed proximate a first side edge of the angled ramp and a second wrist support guide disposed proximate an opposing second side edge of the angled ramp.

16. The ergonomic manicuring support of claim 15 wherein the first wrist support guide cooperates with a first contoured convex hand support and the second wrist support guide cooperates with a second contoured convex hand support to define an opening therebetween.

17. The ergonomic manicuring support of claim 11 wherein the at least one contoured convex hand support further comprises a first contoured convex hand support disposed proximate a first side edge of the platform and a second contoured convex hand support disposed proximate an opposing second side edge of the platform.

18. The ergonomic manicuring support of claim 11 wherein the top edge of the platform further comprises a scalloped edge portion.

19. The ergonomic manicuring support of claim 11 wherein the legs are formed as a right trapezoid to support the angled ramp and platform to position the at least one forearm, wrist and hand of the user for manicuring services.

20. An ergonomic manicuring support apparatus comprising:

an angled ramp including a top edge, a bottom edge wider in length than the top edge and opposing first and second side edges extending between the bottom edge and the top edge, wherein the bottom edge, the top edge and the opposing first and second side edges of the angled ramp form an isosceles trapezoid shaped angled ramp surface configured to receive and support at least one forearm and at least one wrist of a user;

at least one wrist support guide disposed proximate at least one of the opposing side edges of the angled ramp, wherein the at least one wrist support guide further comprises a first wrist support guide disposed proximate the first side edge of the angled ramp and a second wrist support guide disposed proximate the opposing second side edge of the angled ramp;

a platform including a top edge having a scalloped edge portion, a bottom edge wider in length than the top edge and connected to the top edge of the angled ramp and opposing first and second side edges extending between the bottom edge and the top edge, wherein the bottom edge, the top edge and the opposing first and second side edges of the platform cooperate with the angled ramp to form a unitary isosceles trapezoid shaped surface when the bottom edge of the platform is connected to the top edge of the angled ramp to receive and support at least one forearm and at least one wrist of a user;

at least one contoured convex hand support disposed proximate at least one of the opposing side edges of the platform, wherein the at least one contoured convex hand support further comprises a first contoured convex hand support disposed proximate a first side edge of the platform and a second contoured convex hand support disposed proximate an opposing second side edge of the platform to support and prevent movement of the at least one hand of the user, wherein the first wrist support guide cooperates with the first contoured convex hand support and the second wrist support guide cooperates with the second contoured convex hand support to define an opening therebetween;

a pair of legs connected to and supporting the angled ramp and the platform, wherein the legs are positioned on the angled ramp and the platform to allow the top edge of the platform to extend from the legs, wherein the legs are formed as a right trapezoid to support the angled ramp and platform to position the at least one forearm, wrist and hand of the user; and support brackets extending between the pair of legs to structurally reinforce the angled ramp and the platform, wherein the at least one forearm, wrist and hand of the user are positioned and supported by one or more of the angled ramp, the first and second wrist support guides on the angled ramp, the platform and the first and second contoured convex hand supports on the platform to elevate the at least one wrist and the at least one hand of the user and position one or more fingers of the user in a hanging downward position relative to the top edge of the platform to receive manicuring services.

* * * * *